United States Patent [19]

Kumasaka et al.

[11] Patent Number: 4,463,951

[45] Date of Patent: Aug. 7, 1984

[54] BALL

[75] Inventors: Sadao Kumasaka; Satomi Tada, both of Tokyo, Japan

[73] Assignee: Oyo Rubber Chemical Industry Co., Ltd., Tokyo, Japan

[21] Appl. No.: 356,524

[22] Filed: Mar. 9, 1982

[30] Foreign Application Priority Data

| | | | |
|---|---|---|---|
| Mar. 17, 1981 | [JP] | Japan | 56-37322[U] |
| Apr. 22, 1981 | [JP] | Japan | 56-58170[U] |
| May 27, 1981 | [JP] | Japan | 56-77073[U] |
| May 30, 1981 | [JP] | Japan | 56-79847[U] |
| May 30, 1981 | [JP] | Japan | 56-78848[U] |
| Feb. 2, 1982 | [JP] | Japan | 57-15386 |
| Feb. 2, 1982 | [JP] | Japan | 57-15387 |

[51] Int. Cl.[3] ..... A63B 37/02; A63B 39/00

[52] U.S. Cl. ..... 273/58 A; 273/DIG. 8; 273/DIG. 5; 273/58 BA

[58] Field of Search ..... 273/DIG. 5, DIG. 8, 273/DIG. 20, 58 BA, 60 R, 60 A, 60 B, 58 A, 58 B

[56] References Cited

U.S. PATENT DOCUMENTS

| | | | |
|---|---|---|---|
| 2,484,397 | 10/1949 | Barton | 273/DIG. 5 |
| 3,185,476 | 5/1965 | Fechner | 273/58 BA |
| 3,518,786 | 7/1970 | Holtvoigt | 273/DIG. 8 |

*Primary Examiner*—George J. Marlo

*Attorney, Agent, or Firm*—Frishauf, Holtz, Goodman & Woodward

[57] ABSTRACT

The invention provides a ball for a game having a spherical soft polyurethane foam and a surface layer of foamed polyvinyl chloride formed on the surface of the spherical body. The ball is produced by first casting the surface layer in a mold to form a hollow foamed PVC body having closed cells, and then charging a foamed polyurethane composition into the hollow thus formed, to produce a sphere of polyurethane having open cells within the surface layer. Also provided is a ball for games having a spherical body of foamed polyvinyl chloride and having a spherical cavity at the center. The ball is safe, has proper flexibility, and is not subject to punctures.

5 Claims, 6 Drawing Figures

BALL

BACKGROUND OF THE INVENTION

The present invention relates to a ball mainly used for games of children.

As balls for sports and games of children such as soccer balls are conventionally used balls of hard rubber inflated with air as in the case of balls for adults. Balls of hard rubber of this type bring about a lot of fun since they have good elasticity and bound well. On the other hand, since they are relatively hard and heavy, they may hurt the faces or heads of children. Furthermore, with an inflated ball of hard rubber, the internal pressure of the ball is reduced due to leakage of air. Then, a puncture is caused and the ball loses its bounce, requiring care such as refilling of air. Therefore, balls of this type are not suitable for children from this respect as well.

SUMMARY OF THE INVENTION

It is an object of the present invention to provide a ball which is excellent in safety, which has suitable elasticity, and which does not lose elasticity as a result of loss of air which causes a puncture.

It is another object of the present invention to provide a ball which has water-resistance in addition to the properties as described above.

It is still another object of the present invention to provide a ball which has a thin surface film or layer which is strongly adhered to an inner soft foam.

According to an aspect of the present invention, there is provided a ball comprising a spherical soft foam, and a surface layer of polyvinyl chloride formed on the surface of the foam. This ball may be manufactured by forming the surface layer of the ball by rotational casting, injecting a foamable composition within the cavity defined by the surface layer, and foaming the composition to form the soft foam.

Alternatively, the ball may be manufactured by coating the surface of a spherical soft foam with a polyvinyl chloride resin paste, charging the foamed body into a ball forming mold, and curing the resin paste.

Still alternatively, the ball may be manufactured by coating the inner surface of a ball forming mold with a polyvinyl resin paste, charging a spherical foam into the mold, and curing the resin paste. According to the present invention, the soft foam preferably consists of polyurethane or rubber.

According to another aspect of the present invention, there is also provided a ball comprising a spherical body of foamed vinyl chloride having a spherical cavity at the center thereof. This ball is manufactured by rotational casting.

DETAILED DESCRIPTION OF THE PREFERRED EMBODIMENTS

The present invention will now be described by way of its examples.

EXAMPLE 1

Figure 1:
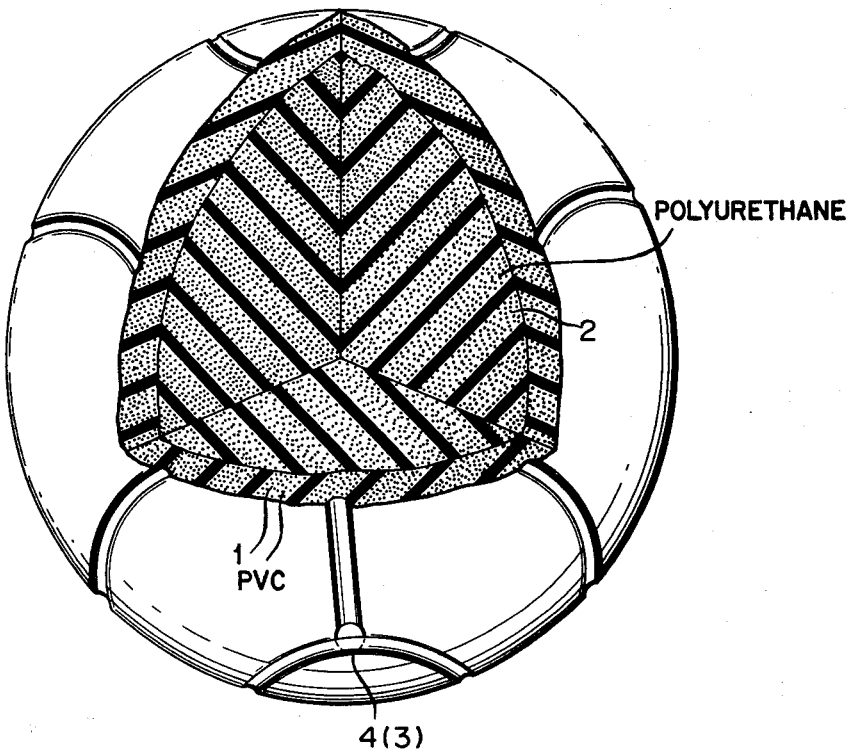
FIG. 1 is a partially cutaway perspective view of a ball according to an embodiment of the present invention.

FIG. 1 is a partially cutaway perspective view of a game ball according to the present invention. A surface layer 1 of 2 to 10 mm thickness is formed by rotational casting of foamed polyvinyl chloride having a specific gravity of 0.2 to 0.5. A soft polyurethane foam of cold-cure type is injected into the cavity defined by the surface layer 1, forming a spherical body. The compositions of the soft polyvinyl chloride of the surface layer 1 and the soft urethane foam 2, and methods for manufacturing the same were as follows:

| | |
|---|---|
| Vinyl Chloride Resin Paste | 100 parts by weight |
| Dioctyl Phthalate | 120 parts by weight |
| Azodicarbonamide | 2.5 parts by weight |
| Stabilizer (zinc stearate) | 2.0 parts by weight |
| Foam Stabilizer | 1.0 part by weight |
| Pigment | 3.0 parts by weight |

The raw materials as represented above were kneaded into a paste. The composition obtained was charged into a ball forming mold in the amount of 140 g. The surface layer of 3 mm thickness was obtained by rotational casting.

| | |
|---|---|
| Trifunctional polyether polyol having 3,000 MW | 95 parts by weight |
| Quadrifunctional polyether polyol having 750 MW | 5.0 parts by weight |
| Diethanolamine | 1.0 part by weight |
| Triethylenediamine | 0.2 part by weight |
| Dibutyltindilaurate | 0.2 part by weight |
| Silicone Oil | 1.5 parts by weight |
| $H_2O$ | 4.0 parts by weight |
| Tolylenediisocyanate (80/20) | 48.0 parts by weight |

The raw materials as presented above were mixed together and the resultant composition was injected into the cavity formed by the surface layer described above.

With a ball of the structure as described above, since the spherical shape is maintained by the soft urethane foam charged inside the surface layer 1, a puncture may not be caused by leakage of air as in the case of a conventional ball. Therefore, the ball of the example does not require much care and may withstand semipermanent use. Since the surface layer 1 is also made of soft vinyl chloride, it has proper flexibility and absorbs impact upon collision with faces or heads of children. Spraining or hurting of fingers may be prevented. Thus, the ball of this example has properties preferable as a ball for children. The ball of the example also has suitable elasticity as will be shown below and may not impair the fun of a game.

Elasticity Test Results

Diameter of Ball: 18 cm
Drop Height: 1 m above the ground (free drop)
Bounce: 0.45 m In a ball manufactured in this manner, the surface layer 1 of foamed polyvinyl chloride has closed cells, while the soft polyurethane foam 2 has open cells.

Figure 2:
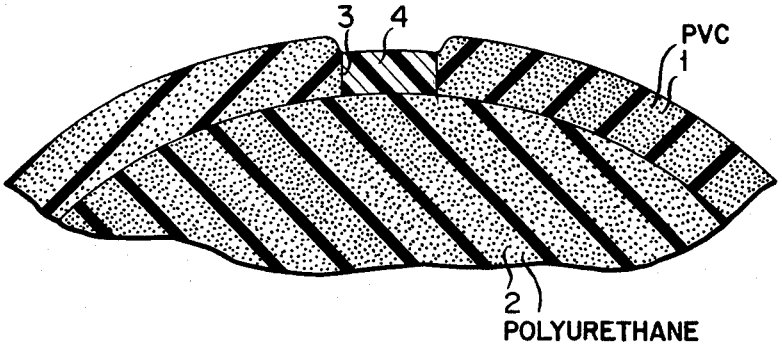
FIG. 2 is a partial, enlarged, sectional view of the ball shown in FIG. 1.

FIG. 2 is a partial, enlarged, sectional view of the ball shown in FIG. 1. Reference numeral 3 denotes a through hole having a diameter of 3 to 7 mm which is formed after the raw material is injected therethrough for rotational casting. A nonfoamed soft resin 4 such as polyurethane elastomer closes the through hole 3.

Since the surface layer 1 has closed cells, it is high in water resistance and hardly absorbs water. On the other hand, since the soft polyurethane foam 2 has open cells, it is low in water resistance and easily absorbs water. Therefore, if the through hole 3 formed in the surface layer is left unclosed, water may permeate into the soft polyurethane foam 2 through the through hole 3 when the ball lands in a pond or puddle. Then, the ball becomes heavier and has a lower elasticity.

However, by closing the through hole 3 with the nonfoamed soft resin 4 which is excellent in water resistance, permeation of water may be prevented.

EXAMPLE 2

Figure 3:
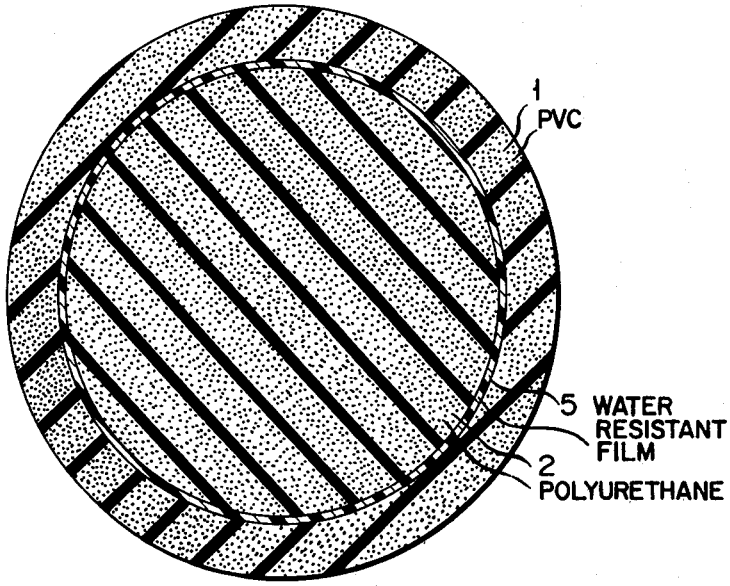
FIG. 3 is a sectional view of a ball according to another embodiment of the present invention.

A ball of this example has a water-resistant film 5 interposed between the surface layer 1 and the soft polyurethane foam 2, as shown in FIG. 3. Referring to FIG. 3, the surface layer has a thickness of 2 to 10 mm and is formed by rotational casting of foamed polyvinyl chloride having a specific gravity of 0.2 to 0.5. The water-resistant film 5 coated by spray coating is formed on the inner surface of the surface layer 1. The soft polyurethane foam 2 of cold-cure type is injected inside the water-resistance film 5, providing a spherical body.

The ball of the example may be manufactured in the following manner.

The raw materials for the foamed PVC as in Example 1 were kneaded into a paste. The paste was charged in the amount of 140 g into a ball forming mold. The surface layer 1 of 3 mm thickness was formed by rotational casting.

A resin solution of the following composition was spray-coated on the inner surface of the surface layer 1 to form the water-resistant film 5:

| | |
|---|---|
| Acrylic Resin Latex | 100 parts by weight |
| Carboxymethyl Cellulose | 0.5 part by weight |
| Melamine Resin | 1.0 part by weight |

After mixing the soft polyurethane foam raw materials of the composition same as that in Example 1, the resultant composition was injected into the cavity defined by the surface layer 1 in the amount of 120 g. Foaming was performed to provide a water-resistant and no-puncture ball having a diameter of 18 cm.

The ball of the structure as described above is safe to play with and a puncture is not formed. Moreover, since the water-resistant film 5 is formed on the inner surface of the surface layer 1, the permeation of the water introduced through the surface layer 1 into the soft polyurethane foam 2 may be prevented.

Examples of the resin solution for forming the water-resistant film include natural rubber latex, synthetic rubber latex, polyamide resin or the like in place of the resin solution containing the acrylic resin as a main component.

EXAMPLE 3

Figure 4:
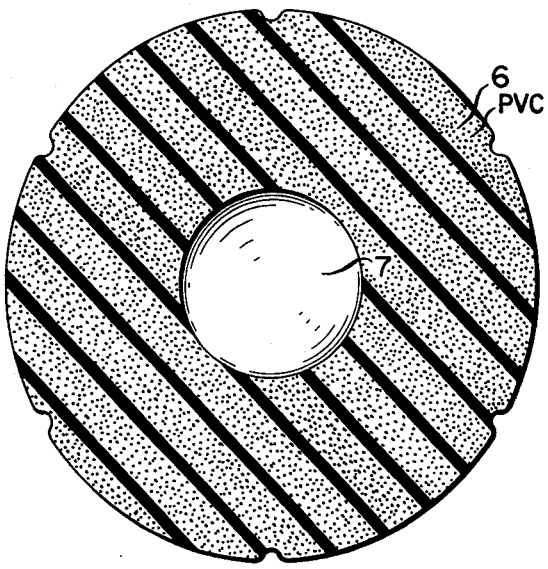
FIG. 4 is a sectional view according to still another embodiment of the present invention.

A ball of this example is shown in FIG. 4.

Referring to FIG. 4, reference numeral 6 denotes a spherical body consisting of foamed polyvinyl chloride. A substantially spherical cavity 7 is formed at the center of the spherical body 6. The spherical body 6 of foamed polyvinyl chloride may be manufactured in the following manner:

| Raw Material Composition: | |
|---|---|
| Vinyl Chloride Resin Paste | 100 parts by weight |
| Dioctyl Phthalate | 120 parts by weight |
| Azodicarbonamide | 2.5 parts by weight |
| Stabilizer (zinc stearate) | 2.0 parts by weight |
| Foam Stabilizer | 1.0 parts by weight |
| Pigment | 3.0 parts by weight |

These raw materials were kneaded into a paste. The paste was charged into a ball forming mold in the amount of 120 g. Rotational casting was performed to provide spherical body 6 having a diameter of 7 cm. A substantially spherical cavity 7 having a diameter of 2.3 cm was formed at the center of the spherical body 6.

With a ball of this structure, the spherical shape of the ball is maintained not by the air pressure filled inside the cavity at the center but by the rigidity and elasticity of the spherical body 6 of foamed polyvinyl chloride. Therefore, a puncture may not be caused by leakage of air as in the case of a conventional ball. The ball of the example can thus withstand semipermanent use without requiring much care. Since the ball is made of foamed vinyl chloride, it has suitable flexibility. The flexibility of the ball is further enhanced by the cavity 7 formed at the center. Therefore, the impact is absorbed and spraining of a finger is not caused when the ball is caught, or injury is not caused when the ball collides with a face or head of a child. Thus, the ball of the example has suitable properties for handling by children. Furthermore, since the ball of the example has suitable elasticity as seen from the test results presented below, it may not impair the fun of games of children.

Elasticity Test Results

Drop Height: 1 m above the ground (free drop)
Bounce: 0.4 m

EXAMPLE 4

Figure 5:
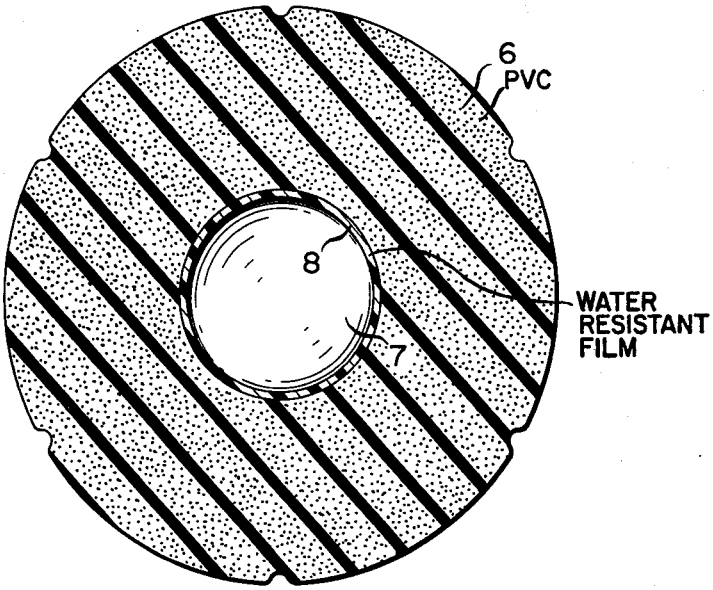
FIG. 5 is a sectional view of a ball according to still another embodiment of the present invention.

A ball of the example is shown in FIG. 5. Referring to FIG. 5, the spherical body 6 consists of foamed polyvinyl chloride. The substantially spherical cavity 7 is formed at the center of the spherical body 6. A water-resistant film 8 containing an acrylic resin as a main component is formed on the surface of the cavity 7 by spray coating.

The ball of this example may be manufactured in the following manner.

The raw material for the foamed PVC as in Example 3 were kneaded into a paste. The paste was charged into a ball forming mold in the amount of 120 g. Rotational casting was performed to provide a spherical body having a diameter of 7 cm. A substantially spherical cavity 7 having a diameter of 2.3 cm was formed at the center of the spherical body 6.

A through hole was formed from the surface of the spherical body 6 to the cavity 7. A resin solution having the composition represented below was coated by spray coating on the surface of the cavity 7 through this through hole to form a water-resistant film 8.

| | |
|---|---|
| Acrylic Resin Latex | 100 parts by weight |
| Carboxymethyl Cellulose | 0.5 part by weight |
| Melamine Resin | 1.0 part by weight |

The through hole formed for the purpose of spray coating was closed to provide the ball of this example.

The ball of the structure as a described above is safe and is free from a puncture as in the case of Example 3. Moreover, the permeation of water introduced from outside into the cavity 7 is prevented by the water-resistant film 8. Therefore, even if the ball lands in a pond or the like and absorbs water, it can be completely dried within a shorter period of time than with the ball of Example 3. Since the water-resistant film 8 is formed not on the surface of the spherical body but on the surface of the cavity 7, the feeling and appearance of the ball may not be impaired irrespective of the type of material used for the water-resistant film 8.

EXAMPLE 5

Figure 6:
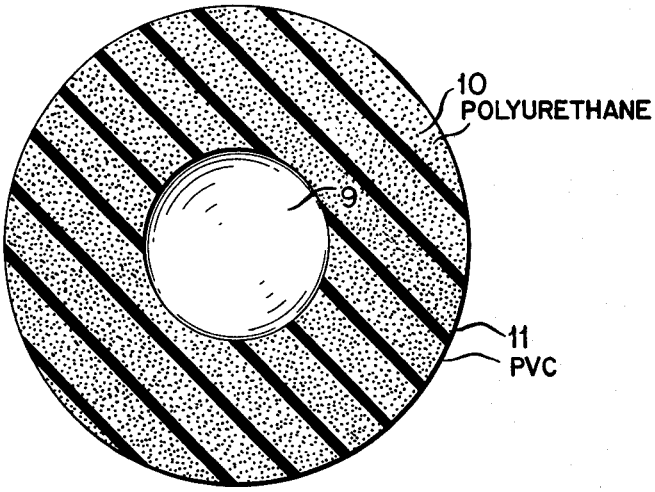
FIG. 6 is a plan view of a semispherical body of polyurethane foam formed in a step according to the present invention.

A semispherical body having a diameter of 20 cm was cut out by three-dimensional cutting from a polyurethane foam block having a specific gravity of 0.027. Part of the inner portion of the semispherical body was further cut out by three-dimensional cutting to provide a semispherical polyurethane foam 10 having a semispherical outer shape and a semispherical cavity 9 inside, as shown in FIG. 6. Two such semispherical polyurethane foams 10 were adhered together to form a spherical polyurethane foam having a spherical outer shape and a cavity inside. Subsequently, a polyvinyl chloride resin paste having the composition represented below was coated to a thickness of 1 mm by spray coating:

| | |
|---|---|
| Vinyl Chloride Resin Paste | 100 parts by weight |
| Dioctyl Phthalate | 120 parts by weight |
| Azodicarbonamide | 2.5 parts by weight |
| Stabilizer (zinc stearate) | 2.0 parts by weight |
| Foam Stabilizer | 1.0 part by weight |
| Pigment | 3.0 parts by weight |

These raw materials were charged into an electroforming mold having a diameter of 20 cm. After heating at 280° C. for 15 minutes by rotational casting, the composition was cooled and was released from the mold. A ball having a surface layer of polyvinyl chloride and of 0.5 mm thickness formed on the surface of a polyurethane foam was obtained.

The peeling test of the surface layer and the polyurethane foam of the ball of this example was performed. No peeling was observed; the polyurethane foam was broken instead.

Although the cavity was formed in this example, it need not be formed. The soft foam having the spherical shape can be alternatively formed by charging a soft foamable raw material into a ball forming mold and foaming the raw material. However, it is preferable to cut out the spherical body by, for example, three-dimensional cutting from a soft foam of block shape as in Example 5.

The polyvinyl chloride resin paste to be coated on the surface of the soft foam having the spherical outer shape obtained in this manner is used to form the surface layer of the ball. Although the paste generally contains a foaming agent, it need not contain a foaming agent if the surface layer is to be formed very thin. If the surface layer must be formed to a relatively great thickness, a resin paste having a high viscosity is used. The resin paste may be coated with a brush or by other suitable means. However, when the paste is coated by spray coating, the surface layer may be coated to a uniform thickness and can be formed to a very small thickness.

After the paste is coated, the foam is charged into a ball forming mold. Although an electroforming mold used in FIG. 5 is preferable, other molds such as aluminum molds, metal sheet molds or the like may also be used. The size of the cavity of the mold is preferably equal to or slightly smaller than the size of the ball to be manufactured. A ball consisting of a soft foam with the integral surface layer is obtained by curing the resin paste coated on the soft foam inside the cavity of mold. If the polyvinyl chloride resin containing a foaming agent is used, the surface layer of polyvinyl chloride foam is formed by foaming simultaneously with curing.

In Example 5, after the soft foam having a spherical outer shape is prepared, a polyvinyl chloride resin paste for forming the surface layer is coated on the surface of the soft foam. Therefore, the surface layer of the soft foam is partially impregnated with the resin paste. Therefore, a strong adhesion is obtained between the surface layer and the soft foam with a ball obtained by curing, so that the soft foam and the surface layer may not separate over a long period of time. In this case, if the cells are exposed to the surface of the soft foam to be coated with the resin paste, the soft foam can be easily impregnated with the resin, resulting in a strong adhesion. For this reason, when the soft foam is cut out from the block, it is preferable to cut out a spherical body in such a manner as to expose the cells to the surface thereof. When the ball is manufactured by molding, a thin skin layer is formed on the molded spherical body, so that the effects of impregnation with the resin paste become relatively small.

Since the polyvinyl chloride resin paste can be coated to a very small thickness in Example 5, a no-puncture ball having a very thin surface layer can be obtained. In this case, the feeling of the soft foam is transmitted to the hands through the surface layer. If the surface layer is a thin layer, the surface layer need not be a foamed layer. Therefore, even if the surface layer is made of nonfoamed polyvinyl chloride resin, a no-puncture ball which is sufficiently soft and safe can be obtained.

EXAMPLE 6

A semispherical body having a diameter of 20 cm was cut out by three-dimensional cutting from a polyurethane foam block having a specific gravity of 0.027. A semispherical polyurethane foam 10 having a semispherical cavity 9 was obtained by cutting out part of the inner portion of the semispherical body by three-dimensional cutting, as shown in FIG. 6. Two such semispherical polyurethane foams 10 were adhered by an adhesive to provide a polyurethane foam having a spherical outer shape and a cavity inside. A polyvinyl resin paste of the composition same as that used in Example 5 was coated to a thickness of 2 mm by spray coating on the surface of a cavity of an electroforming, ball-forming mold having a diameter of 20 cm.

Subsequently, the polyurethane foam was charged into this electroforming mold. Rotational casting was performed at 280° C. for 15 minutes. The ball was cooled and was released from the mold. Thus, a ball having a polyurethane foam and a surface layer of polyvinyl chloride having a thickness of 1 mm and formed integrally with the foam was obtained.

The ball exhibited excellent characteristics as the ball in Example 5.

What we claim is:

1. A ball comprising:

a spherical body of polyurethane foam having open cells, and a surface layer of foamed polyvinyl chloride having closed cells integrally formed on the surface of said spherical body of polyurethane foam;

said ball having been produced by forming said surface layer by rotational casting in a mold to form a hollow foamed polyvinyl chloride body having closed cells and a central cavity therein and charging a foamable polyurethane composition into said cavity and foaming said composition to integrally form a spherical body of polyurethane foam having open cells integral with said surface layer of foamed polyvinyl chloride having closed cells.

2. The ball of claim 1 wherein said surface layer has a thickness of from 2 to 10 mm.

3. The ball of claim 1 wherein said surface layer is formed with a through hole during rotational casting and the through hole is closed by a non-foamed polyurethane after said foamable polyurethane composition is charged into said cavity.

4. The ball of claim 1 containing a water resistant layer between said surface layer and said spherical body and integral with said spherical body and said surface layer.

5. The process of forming a ball comprising rotationally casting foamable polyvinyl chloride to form a hollow spherical polyvinyl chloride layer having closed cells and a thickness of from 2 to 10 mm; and charging a foamable polyurethane composition into the cavity formed in the interior of said hollow polyvinyl chloride spherical body and foaming said polyurethane composition to form a spherical body of polyurethane foam having open cells integral with and internal of said spherical body of foamed polyvinyl chloride thereby forming a ball having a surface layer of said foamed polyvinyl chloride having closed cells integral with said spherical body of polyurethane foam having open cells.

* * * * *

UNITED STATES PATENT AND TRADEMARK OFFICE

CERTIFICATE OF CORRECTION

PATENT NO. : 4,463,951

DATED : August 7, 1984

INVENTOR(S) : Sadao KUMASAKA et al

It is certified that error appears in the above-identified patent and that said Letters Patent is hereby corrected as shown below:

Title Page, left column: After "Assignee," "Oyo Rubber Chemical Industry Co., Ltd." should be --Toyo Rubber Chemical Industry Co., Ltd.--.

Signed and Sealed this

*Twenty-eighth* Day of *January 1986*

[SEAL]

*Attest:*

DONALD J. QUIGG

*Attesting Officer*

*Commissioner of Patents and Trademarks*